US008176679B2

(12) United States Patent
Klippert et al.

(10) Patent No.: US 8,176,679 B2
(45) Date of Patent: May 15, 2012

(54) GEAR MECHANISM PART FOR A CABLE-CONTROLLED WINDOW LIFTER AND DRIVE UNIT FOR A CABLE-CONTROLLED WINDOW LIFTER

(75) Inventors: Uwe Klippert, Oberaula (DE); Horst Weber, Wirsberg (DE); Armin Stahn, Kueps (DE); Stephan Stetter, Ebern (DE)

(73) Assignee: Brose Fahrzeugteile GmbH & Co. Kommanditgesellschaft, Hallstadt (DE)

( * ) Notice: Subject to any disclaimer, the term of this patent is extended or adjusted under 35 U.S.C. 154(b) by 470 days.

(21) Appl. No.: 12/544,809

(22) Filed: Aug. 20, 2009

(65) Prior Publication Data

US 2010/0043294 A1 Feb. 25, 2010

Related U.S. Application Data

(63) Continuation of application No. PCT/EP2008/001229, filed on Feb. 18, 2008.

(30) Foreign Application Priority Data

Feb. 20, 2007 (DE) ..... 20 2007 002 470 U

(51) Int. Cl.
*E05F 11/48* (2006.01)

(52) U.S. Cl. ..... 49/352; 49/349

(58) Field of Classification Search ..... 49/348, 49/349, 352; 254/278, 342, 373; 242/390.2, 242/390.8, 390.9, 396.6, 407
See application file for complete search history.

(56) References Cited

U.S. PATENT DOCUMENTS

| | | | | |
|---|---|---|---|---|
| 5,199,310 | A * | 4/1993 | Yoshimura | 74/89.2 |
| 5,511,443 | A * | 4/1996 | Munekhoff | 74/505 |
| 5,564,231 | A * | 10/1996 | Tajima et al. | 49/352 |
| 5,950,365 | A | 9/1999 | Lieb et al. | |
| 6,052,946 | A * | 4/2000 | Isomura | 49/352 |
| 6,223,614 | B1 * | 5/2001 | Takiguchi et al. | 74/411 |
| 6,408,572 | B1 * | 6/2002 | Uchimura et al. | 49/352 |
| 6,655,089 | B2 * | 12/2003 | Le Gallo | 49/352 |
| 7,059,085 | B1 * | 6/2006 | Chu | 49/352 |
| 7,350,334 | B2 * | 4/2008 | Smith | 49/352 |
| 7,823,329 | B2 * | 11/2010 | Stahn et al. | 49/352 |
| 2002/0046497 | A1 * | 4/2002 | Le Gallo | 49/352 |
| 2005/0067521 | A1 * | 3/2005 | Klippert | 242/390.8 |
| 2005/0229493 | A1 * | 10/2005 | Ootsuki et al. | 49/352 |
| 2005/0241236 | A1 * | 11/2005 | Smith | 49/352 |
| 2006/0059781 | A1 * | 3/2006 | Berklich et al. | 49/352 |
| 2007/0175098 | A1 * | 8/2007 | Stahn et al. | 49/280 |
| 2007/0209283 | A1 * | 9/2007 | Ostrowski et al. | 49/360 |
| 2008/0093496 | A1 * | 4/2008 | Klippert | 242/390.8 |

FOREIGN PATENT DOCUMENTS

| | | | |
|---|---|---|---|
| DE | 44 16 979 | C2 | 12/1994 |
| DE | 196 18 853 | C1 | 8/1997 |
| DE | 203 07 885 | U1 | 9/2003 |
| DE | 103 61414 | A1 | 7/2005 |
| DE | 10 2004 014 424 | A1 | 10/2005 |
| EP | 1 514 989 | A2 | 3/2005 |
| EP | 1 617 028 | A1 | 1/2006 |

* cited by examiner

*Primary Examiner* — Katherine W Mitchell
*Assistant Examiner* — Justin Rephann
(74) *Attorney, Agent, or Firm* — Muncy, Geissler, Olds & Lowe, PLLC

(57) ABSTRACT

A gear mechanism part for a cable-controlled window lifter is provided that includes a gear wheel and a cable drum that can be driven by the gear wheel. The gear wheel and cable drum are disposed on a common axis. The gear wheel and the cable drum are coupled by a positive fit to an outside gearing disposed on an outside circumference projection. In the cable drum, a fitting chamber for cable end fastening is provided. The fitting chamber is disposed inside the outer circumference projection on a cross-sectional plane projected perpendicular to the axis. In this way, a more compact design of the cable drum and transmission of higher driving torque are achieved.

16 Claims, 10 Drawing Sheets

GEAR MECHANISM PART FOR A CABLE-CONTROLLED WINDOW LIFTER AND DRIVE UNIT FOR A CABLE-CONTROLLED WINDOW LIFTER

This nonprovisional application is a continuation of International Application No. PCT/EP2008/001229, which was filed on Feb. 18, 2008, and which claims priority to German Patent Application No. DE 20 2007 002 470.3, which was filed in Germany on Feb. 20, 2007, and which are both herein incorporated by reference.

BACKGROUND OF THE INVENTION

1. Field of the Invention

The invention relates to a gear mechanism part for a cable-controlled window lifter as well as to a drive unit for a cable-controlled window lifter.

2. Description of the Background Art

A cable-controlled window lifter is used to raise and lower a window of a motor vehicle. A cable-controlled window lifter of this type is known, for example, from EP 1 617 028 A1. The cable-controlled window lifter described therein has two guide rails, along each of which a driver is movably mounted. The window pane is attached to the two drivers. A cable pull, which may be driven by a drive unit, is also pivoted to the driver. The cable of the cable pull is partially wound onto a cable drum, which is drivable by the drive unit and is provided with a cable groove. With the aid of the drive unit, either both drivers—and thus the window pane—are moved up, or if the driving direction is reversed, both drivers—and thus the window pane—are moved down. Cable-controlled window lifters having only one guide rail and one driver are also known.

Driving the cable drum with the aid of a gear wheel driven by the drive unit is known in the conventional art. In this regard, the gear wheel and cable drum are disposed on a common axis. The gear wheel and cable drum are coupled to each other by positive fit between an outer gearing disposed on an inner circumferential projection and an inner gearing disposed on an outer circumferential projection. At least one fitting chamber is introduced into the cable drum for fastening the cable ends. For this purpose, the cable end has a fitting which is inserted into the fitting chamber during mounting. Dividing the gear mechanism part between the gear wheel and the cable drum simplifies mounting the cable pull wound on the cable drum. The cable drum having the cable attachment may be removed for mounting the gear wheel. In this regard, the drive unit, guide rail, deflection roller and driver my be premounted on the cable-controlled window lifter.

During final mounting, only the cable needs to be attached to the driver and to the cable drum and the cable drum coupled to the gear wheel. In this manner, it is possible to replace a defective drive unit easily, quickly and without problems.

Separating the gear wheel and cable drum also makes it possible to use different materials, optimized to the particular application, for the gear wheel and the cable drum. The gear wheel, in particular, may be made of a strong, wear-resistant and lubricant-resistant plastic, which has a long service life under mechanical load. The cable drum, in particular, is made of a plastic having good static friction properties, lending the cable guidance a high coefficient of friction and practically preventing the cable from twisting or even being dislodged from its cable groove.

SUMMARY OF THE INVENTION

It is therefore an object of the present invention to provide a gear mechanism part for a cable-controlled window lifter, comprising a gear wheel and a cable drum driven by the gear wheel. The object of the invention is further to provide an alternative drive unit for a cable-controlled window lifter.

In an embodiment, a necessary fitting chamber can influence the size of both components of the gear mechanism part, in particular that of the cable drum. To ensure easy accessibility, the fitting chamber in conventional gear mechanism parts are disposed in a radial direction outside the geared coupling. To obtain sufficient space for introducing the fitting chamber, the circumference of the toothed coupling is reduced to accommodate a given circumference of the cable drum.

In a further embodiment, the transmittable driving torque can be lower with a smaller gearing diameter than with a larger gearing diameter.

In yet a further embodiment, the gearing diameter may be enlarged by disposing the fitting chamber outside the gearing coupling in the radial direction, in other words by disposing it within the outer circumferential projection on a cross-sectional plane projected perpendicular to the axis. Since the circumferential projections supporting the gearing do not necessarily have to be designed circumferentially, but may also have an at least partially penetrated design, the accessibility of the fitting chamber is not necessarily impaired thereby.

This results in a geometry of the gear mechanism part, whereby the gearing between the gear wheel and the cable drum is implemented by a larger diameter in comparison to the current design. Since the fitting chamber is accommodated in a space which is already required by the design, and no additional component volume is needed for introducing the fitting chamber, the invention additionally makes it possible to provide the structural volume of the gear unit with a more compact overall design. Compared to the current design of the coupling between the gear wheel and cable drum, a higher torque is transmittable. The force transmitted from the gear wheel to the cable drum is distributed to a larger circumference and to a larger number of teeth. This reduces the mechanical load on each tooth. The risk that the coupling point will fail due to breakage or deformation of one or more teeth is reduced. On the other hand, the lower load per tooth also enables simpler and thus more cost-effective materials to be selected.

For the invention, it is also irrelevant whether the outer circumferential projection is assigned to the gear wheel and the inner circumferential projection is assigned to the cable drum or whether the inner circumferential projection is assigned to the gear wheel and the outer circumferential projection is assigned to the cable drum. The gearing itself may have just a few or many teeth. In other cases, the inner gearing and the outer gearing may each be formed by a coupling element which engages with the corresponding other coupling element. The circumferential projections may each be designed circumferentially or have one or more passages. The circumferential projections also do not necessarily have to have an annular design. Other wall shapes for supporting the gearing are also possible.

The outer circumferential projection on the corresponding component advantageously can also engage with an annular channel. The outer wall of the annular channel lends additional mechanical stability to the coupling point. This avoids the danger of the cable drum tilting during operation of the cable-controlled window lifter. The annular channel also acts as an insertion or mounting aid when coupling the gear wheel to the cable drum.

In an embodiment, the teeth of the outer gearing and/or of the inner gearing can have an essentially rectangular structure. A geometry of this type is made possible by the enlarged circumference and makes it easier to couple the cable drum to the gear wheel, since a radial offset of the components is tolerated within certain limits during engagement, unlike in the case of a pointed tooth geometry. The danger of a rectangular tooth breaking due to the tangential introduction of force is minimized by the tooth thickness. The reduced number of teeth associated herewith also makes it easier for the cable drum and gear wheel to fit together. Manufacturing is also simplified and therefore also more economical. In the usual design of the gear wheel and/or the cable drum as a molded plastic part, it is easier, for example, to introduce a rectangular tooth geometry into a mold than a tool geometry having pointed teeth. In addition, more material is located at the end surfaces of the rectangular teeth than in the case of pointed teeth. This ensures that an injection mold is more effectively filled with the injected plastic than is the case with pointed teeth. The gear wheel or the cable drum may thus be produced in large-batch production as a mass-produced product having a lower reject rate. Rectangular teeth also make it possible [rest of sentence missing in the German].

In an embodiment, the teeth of the outer gearing and/or of the inner gearing can be beveled in the component joining direction, i.e. they are provided with a slanted edge. The tooth beveling may be provided on the outer gearing and/or on the inner gearing. The beveling makes it easier for the gear wheel and cable drum to engage with each other in a positive coupling. The tooth beveling therefore also acts as an insertion or mounting aid.

The outer circumferential projection of the inner gearing can be disposed on the cable drum and the inner circumferential projection having the outer gearing can be disposed on the gear wheel. By this means, the larger space in relation to the inner gearing projection is available within the outer gearing projection for accommodating the fitting chamber. The gear wheel and cable drum may thus be designed in a particularly compact geometry.

In a further embodiment, the drum circumference of the cable drum is smaller than the outer circumferential projection. In other words, the drum part of the cable drum can be offset to the inside in the radial direction relative to the outer circumferential projection. The transition between the outer circumferential projection and the cable drum is thus provided with a stepped design. This stepped design is used, for example, as a guide aid for the cable of the cable pull wound onto the cable drum. The risk of the cable being displaced from the cable groove is thus small. A particularly good lever arm for the cable pull may also be implemented thereby, so that the cable-controlled window lifter is operable by a low-power drive motor.

In an embodiment, the fitting chamber can be introduced into the cable drum, oriented tangentially relative to the axis. In other words, the fitting chamber is oriented in such a way that, after insertion, the longitudinal direction of the cable fitting lies tangentially relative to the axis. It is therefore possible to particularly easily insert the cable end with the fitting into the fitting chamber in the direction of pull. After the fitting is inserted into the fitting chamber, the fitting is drawn against a stop surface by the tensile force of the cable and thereby held securely in place. The stop surface is oriented in such a way that the tensile force acts upon it in the perpendicular direction. Due to the tangential orientation of the fitting chamber, kinking of the cable or bending of the fitting against the cable direction is reliably avoided.

In an embodiment, a cable groove connecting the drum circumference to the fitting chamber can be introduced into the cable drum. The cable is thereby fed out of the fitting chamber in a defined manner. In particular, tangentially feeding the cable out of the fitting chamber at a constant curvature in the circumferential direction of the drum reliably prevents the cable from kinking at its end. Instead, the cable is gently fed from the fitting chamber and lightly follows the curvature of the cable drum as it exits the cable groove.

Two fitting chambers, which are offset against each other in the axial direction and are oriented in opposition to each other, can be introduced into the cable drum, both fitting chambers being disposable within the outer circumferential projection on a cross-sectional plane projected perpendicular to the axis. In a cable-controlled window lifter with two drivers enables the cables assigned to the two drivers to be connected to the cable drum in such a way that an equilibrium of forces results. By orienting the fitting chambers in opposition to each other, one cable unwinds as the cable drum rotates, while the other cable winds, and vice versa.

The two fitting can be disposed above one another in the axial direction of the cable drum and formed by a continuous channel. This makes it possible to easily manufacture the cable drum, since the fitting chambers may be easily impressed into the component in this manner, in particular when the component is manufactured as a molded plastic part.

A plurality of embodiments are possible for coupling the gear wheel to a drive. The coupling may be via a corresponding gear mechanism having parallel, intersecting or crossing gear mechanism axes for transmitting the driving speed. Depending on the design of the gear mechanism, this also makes it possible to select the position of the drive motor and thus the position of the drive axis. The gear mechanism may be provided with a self-locking as well as with a non-self-locking design.

In an embodiment, the gear wheel can be designed as worm wheel that meshes with a worm shaft. The worm shaft in this case is attached, in particular, to a shaft of a drive motor so that the drive motor shaft is disposed perpendicular to the axis of the gear wheel. This makes it possible to dispose the drive motor on a plane with the gear wheel. In this manner, a drive unit comprising the drive motor and the worm shaft may be installed in the side paneling of a motor vehicle in a way that saves space. A worm gear mechanism implemented with the aid of a worm shaft and a worm wheel may also be easily provided with self-locking design, so that the window pane is safely supported by its own weight and held in place by the worm gear mechanism even when the drive motor is in the deenergized state.

In an embodiment, a wrap spring can be disposable on the axis, the ends of this wrap spring being in detachable engagement with the gear wheel and in locking engagement with the cable drum. The larger circumference of the gearing makes it possible to install the wrap spring. A more or less cylindrical recess may be introduced into both the gear wheel and the cable drum around the axis, the wrap spring being introduced therein such that it is disposed around the axis. The wrap spring unit is designed, for example, as a helical spring, whose ends are bent to the outside in the radial direction. Force may thus be applied to the ends by both the gear wheel and by the cable drum. This application of force is implemented, for example, with the aid of shells acting inversely against the ends, the shells being disposed on the cable drum or on the gear wheel. Any other coupling element is also conceivable. The system is designed in such a way that a rotation of the gear wheel in the clockwise or counterclockwise direction results in the detachment of the wrap spring, and a rotation of the cable drum results in a locking of the wrap spring. If a helical spring is used, the gear wheel operates against the winding direction and the cable drum in the winding direction. The drive-side torque is thus introduced into the cable drum without locking. However, if a torque is introduced via the cable drum, in particular as a result of the weight of the window pane, the wrap spring is tightened around the axis. A force acting upon the cable pull of the cable-controlled window lifter is not transmitted to the drive.

With the aid of the wrap spring, a so-called wrap spring brake can be implemented whose use is particularly suitable if a non-self-locking gear mechanism is provided for driving the gear wheel. The window pane is held securely in any position, even if the drive motor is in the deenergized state. This makes it possible to save energy. The wrap spring brake may, of course, also be used in the case of a self-locking gear mechanism, for example to provide additional mechanical protection.

In a further embodiment, the axis can be metallized or made of metal in the area of the wrap spring. A favorable friction pairing between the axis and wrap spring may be provided in this manner.

A further object is achieved according to the invention by a drive unit for a cable-controlled window lifter, comprising a drive motor, a control unit and a gear mechanism part. The drive motor, the control unit and the gear mechanism part are mounted in this case on a common housing.

A drive unit of this type may be used for a fully premounted cable-controlled window lifter as well as for a cable-controlled window lifter that is configurable on site. The drive unit in this case forms a mounting unit which is particularly easy to mount, due to the two-part design of the gear mechanism part comprising a gear wheel and a cable drum. The cable drum may be easily coupled to the gear wheel driven by the drive motor, due to the positive fit. It is also possible to easily replace the drive unit if a defect occurs. The housing forms, in particular, bearing shells for mounting the rotationally movable parts, such as, in particular, gear mechanism parts or cable drums.

The embodiments directed to the gear mechanism unit, along with their advantages, also apply in the same manner to the drive unit.

If the gear wheel is designed as a worm wheel that meshes with a worm shaft, the worm shaft can rest directly on the shaft of the drive motor. The worm shaft and worm wheel form a worm gear mechanism. This results in a compact and flat mounting unit, the drive motor being disposed on the plane of the gear wheel. A drive unit of this type is thus easily mountable at limited installation depth in a side paneling of a motor vehicle. A drive unit having a worm gear mechanism is also usually self-locking. In this manner, the window pane is held in place even in the non-current-conducting state. The worm wheel is supported on the worm shaft. It is not necessary to energize the drive motor in this event in order to hold the window pane in place.

In an embodiment, the axis of the drive unit can be part of the housing. In other words, the axis is molded onto the housing or molded out of the housing. The gear mechanism part comprising the gear wheel and cable drum is therefore easily pushed onto the axis. Integrating the axis into the housing makes it possible to eliminate one mounting step. The total cost of manufacturing and mounting is thereby reduced.

The housing can be made of plastic. For example, the housing is thus easily manufactured in an injection molding process.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
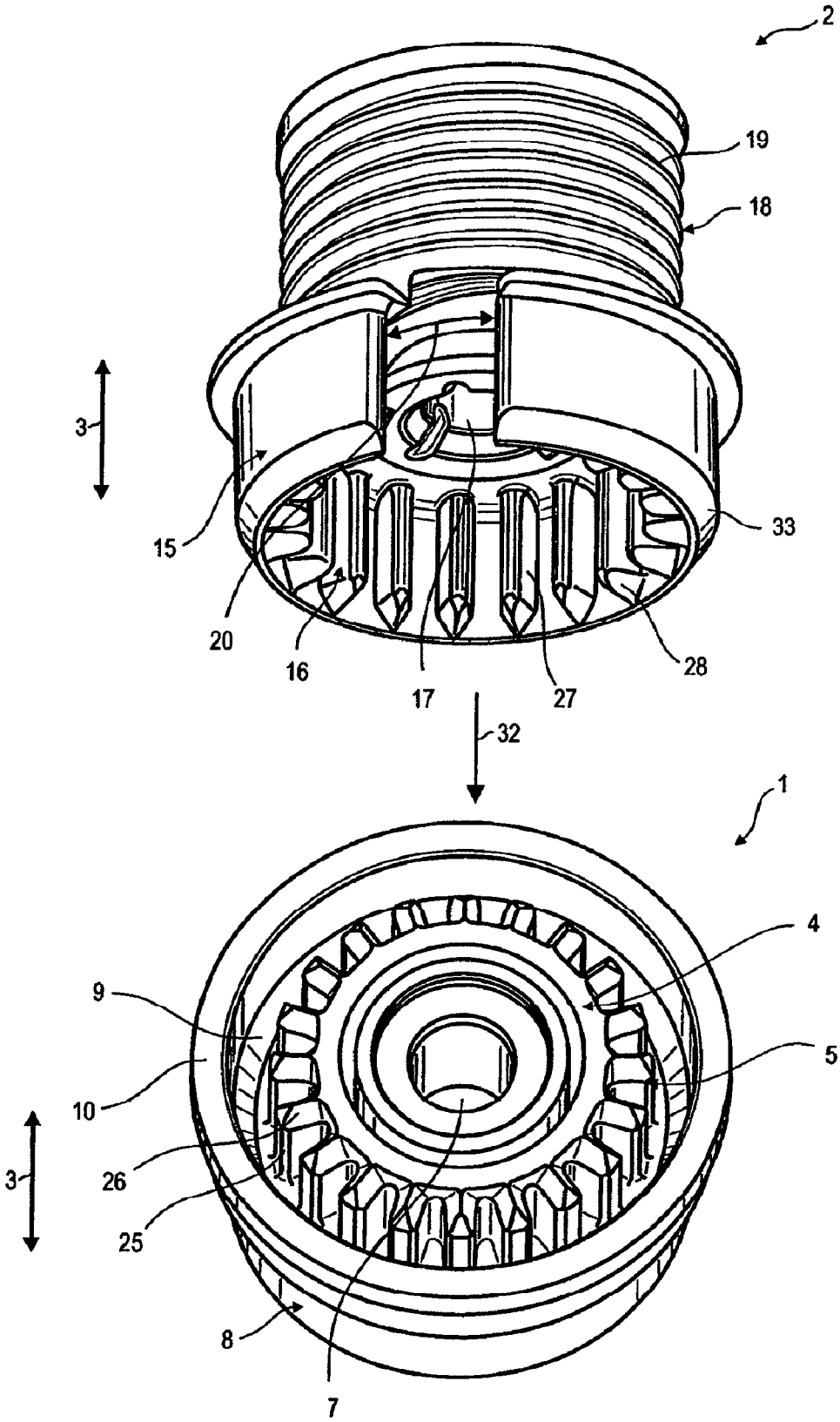
FIG. 1 shows a perspective view of the gear wheel and cable drum of a gear mechanism unit.

A gear wheel 1 and a cable drum 2 are illustrated in FIG. 1 as parts of a gear mechanism unit. Both gear wheel 1 and cable drum 2 are made of plastic and manufactured, in particular, as molded plastic parts. Gear wheel 1 has an essentially cylindrical symmetry with an axial direction 3. A circular annular inner circumferential projection 4 having outer gearing 5 disposed thereupon is visible in the interior. Gear wheel 1 further has in a centrally situated bore 7, which extends centrally over the entire length in axial direction 3, for rotationally accommodating an axis. Outer gearing 5 is followed by an annular channel 9, which is limited by an outer wall 8, in the radial direction toward the outside. Outer wall 8 is provided with a flat support surface 10 at its upper end.

Gear wheel 1 is further designed as a worm wheel for coupling to a worm shaft. For this purpose, gear wheel 2 is provided with a spiral gearing, which is not illustrated in FIG. 1 and which runs around the outer circumference of outer wall 8 and extends over a portion of the height of outer wall 8.

Cable drum 2 also has an essentially cylindrical symmetry. An essentially circular annular outer circumferential projection 15, which is provided with an inner gearing 16, is molded out of cable drum 2 in the lower third thereof according to FIG. 1, in axial direction 3. A central bore 17 is also introduced in the center of cable drum 2. Outer circumferential projection 17 is followed in axial direction 3 by a drum part 18 having a drum circumference which is smaller than the circumference of outer circumferential projection 15. A cable groove 19 is provided in a helical manner along the lateral surface of drum part 18 for guiding a wound cable in multiple windings. A passage 20 for passing a cable end of the cable, which is not illustrated in FIG. 1, into the interior of outer circumferential projection 15 is introduced into outer circumferential projection 15. Inner gearing 16 of outer circumferential projection 15 corresponds in positive fit to outer gearing 5 of inner circumferential projection 4 of gear wheel 1.

Outer gearing 5 of inner circumferential projection 4 of gear wheel 1 includes teeth 25 having an essentially rectangular structure. Teeth 25 have a bevel 26 on their upper end in axial direction 3 in order to facilitate joining with cable drum 2. Teeth 27 of inner gearing 16 also have an essentially rectangular structure. A bevel 28 is introduced into the lower end of each tooth 27 in axial direction 3. Due to the rectangular geometry of teeth 25, 27 having a relatively great thickness, it is possible to securely couple components 1 and 2 mechanically and to easily join them together. This is additionally supported by bevels 26 and 28. Due to the rectangular shape of teeth 25 and 27, components 1 and 2 are also comparatively easy to manufacture.

To couple gear wheel 1 and cable drum 2 in positive fit, cable drum 2 is mounted on the gear wheel in joining direction 32 in such a way that bores 7, 17 are in alignment with each other in axial direction 3. Outer circumferential projection 15 having teeth 27 of inner gearing 16 engages with teeth 25 of outer gearing 5 of inner wall 4. In addition, outer circumferential projection 15 is inserted into annular channel 9 of gear wheel 1. Bevels 26, 28 of teeth 25, 27 act as an insertion aid and facilitate mounting. Mounting is further facilitated by a bevel 33, which is introduced circumferentially into the outside of outer wall 15 and facilitates insertion into annular channel 9. After cable drum 2 has been mounted on gear wheel 1, cable drum 2 is additionally supported by outer wall 8 of annular channel 9.

Figure 2:
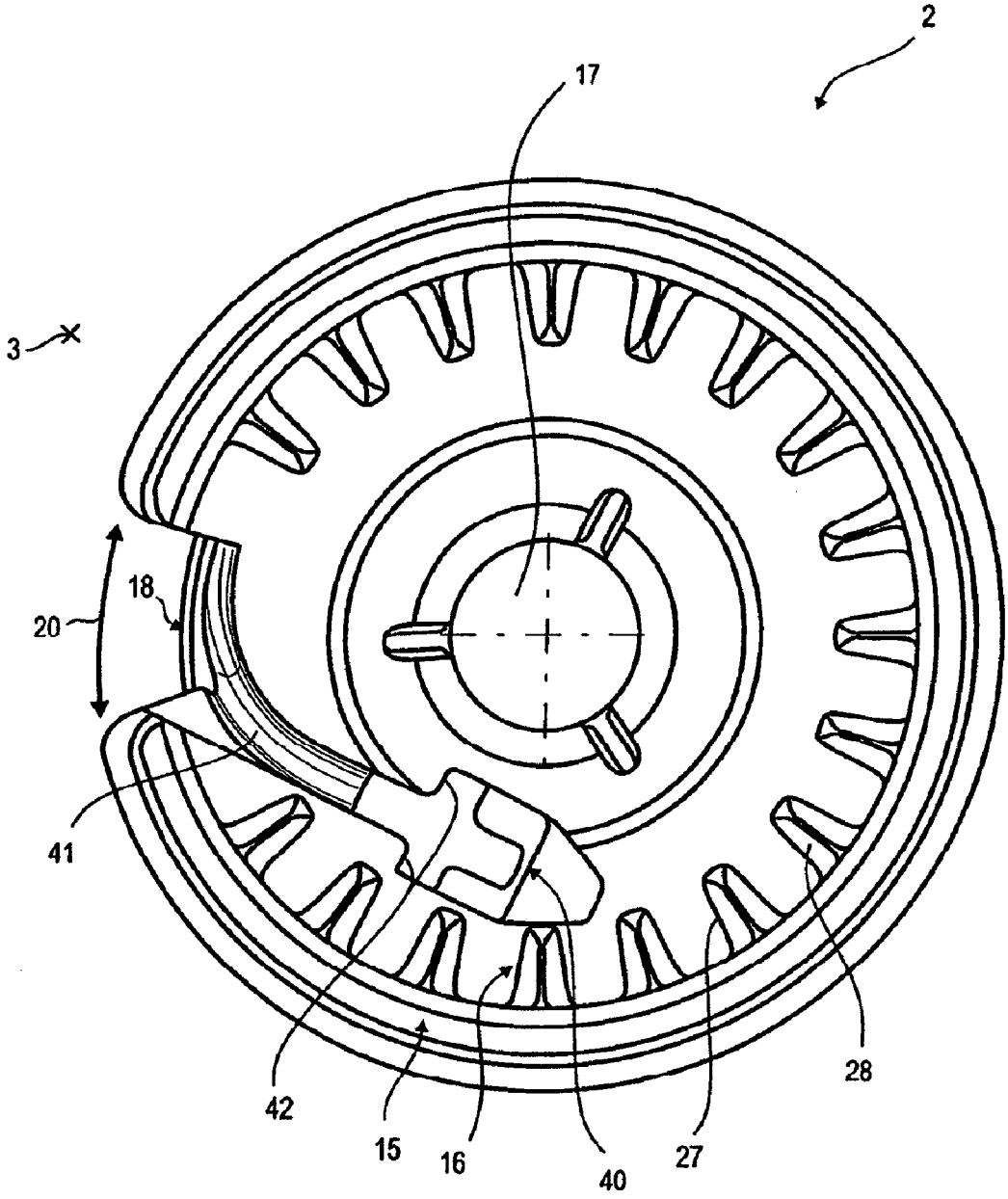
FIG. 2 shows a top view of the cable drum according to FIG. 1.

FIG. 2 shows a top view of cable drum 2 according to FIG. 1, viewed from the side of its outer circumferential projection 15. Cable drum 2 has a fitting chamber 40 in its interior. In the top view shown, it is apparent that the fitting chamber is disposed within outer circumferential projection 15 on a cross-sectional plane projected perpendicular to central bore 17. An end of a cable which is provided with a fitting and which is not illustrated in FIG. 2 is inserted into this fitting chamber 40. Fitting chamber 40 is introduced into cable drum 2 tangentially relative to the central longitudinal axis. Fitting chamber 40 is connected to the circumference of drum part 18 via a cable groove 41. The inserted cable is fed to the outside via passage 20 and is at least partially wound onto the cable groove running along the drum circumference, as shown in FIG. 1. Since the cable is subjected to a tensile load, the fitting is drawn against a radially oriented fitting stop 42 by its side facing the cable and it is thereby held securely in place in fitting chamber 40. Cable groove 41 is continuously curved, so that the inserted cable is bent gently from the tangential direction in the interior of cable drum 2 to the circumferential direction of drum part 18. This reliably prevents kinking of the cable.

Figure 3:
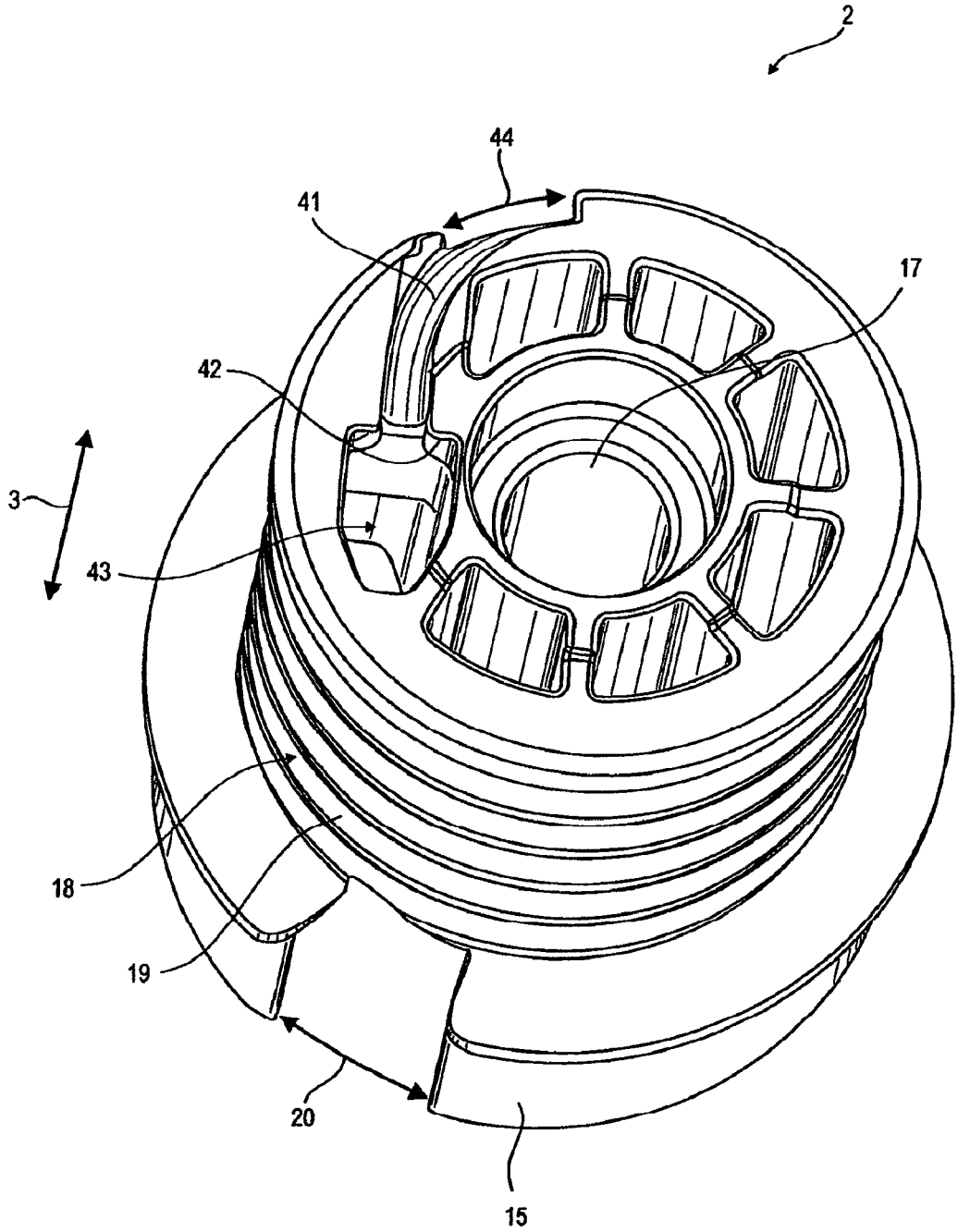
FIG. 3 shows a perspective view of the cable drum according to FIG. 1.

FIG. 3 shows the end of cable drum 2 situated opposite outer circumferential projection 15 in axial direction 3. In this case, cable drum 2 includes a further fitting chamber 43, which is oriented in opposition to fitting chamber 40. It is apparent that fitting chamber 43 is also disposed within outer circumferential projection 15 in a cross-sectional plane projected perpendicular to central bore 17. An end of a further cable which is provided with a fitting and which is not illustrated in FIG. 3 is also inserted into this fitting chamber 43. Fitting chamber 43 is also introduced into cable drum 2 tangentially relative to the cylindrical symmetry. The cable may again be fed to the outside and be partially wound on cable groove 19 running around the drum circumference via a cable groove 41 and a passage 44 in drum circumference 18. Both fitting chambers 40, 43 are disposed above one another in axial direction 3 and provided in a continuous channel. Ease of manufacturing is made possible thereby. Material consumption may also be reduced.

By orienting fitting chambers 40, 43 in opposition to each other, one cable unwinds as cable drum 2 rotates, while the other cable winds, and vice versa. In the case of a revolving cable whose ends are inserted into fitting chambers 40, 43, the direction of rotation therefore determines the direction of cable movement and thus the direction in which a window pane connected to the cable is adjusted.

Figure 4:
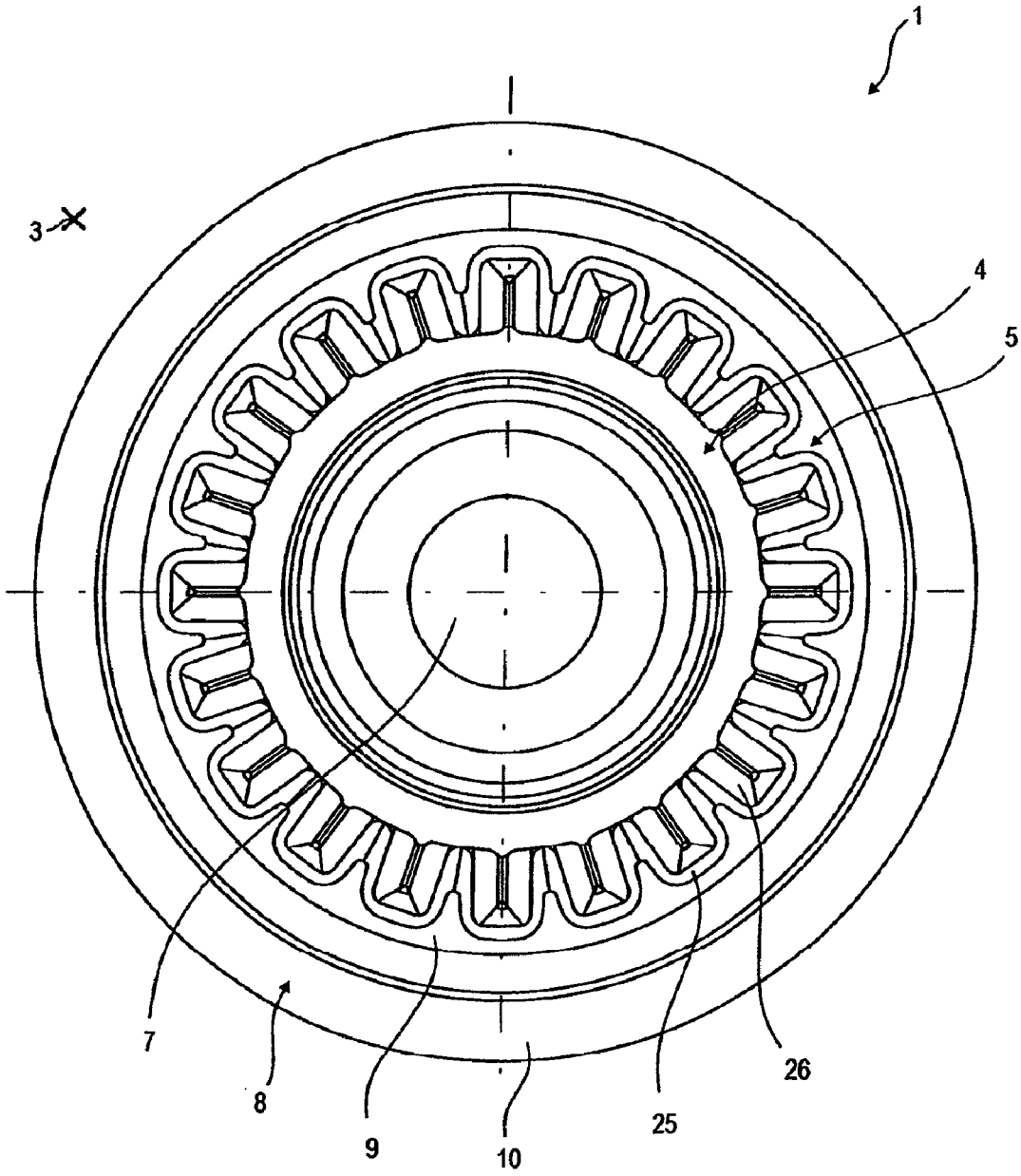
FIG. 4 shows a top view of the gear wheel according to FIG. 1.

FIG. 4 shows another top view of gear wheel 1 according to FIG. 1 for clarification. The figure clearly shows inner circumferential projection 4, including outer gearing 5 disposed thereupon. Annular channel 9 is also clearly shown.

Figure 5:
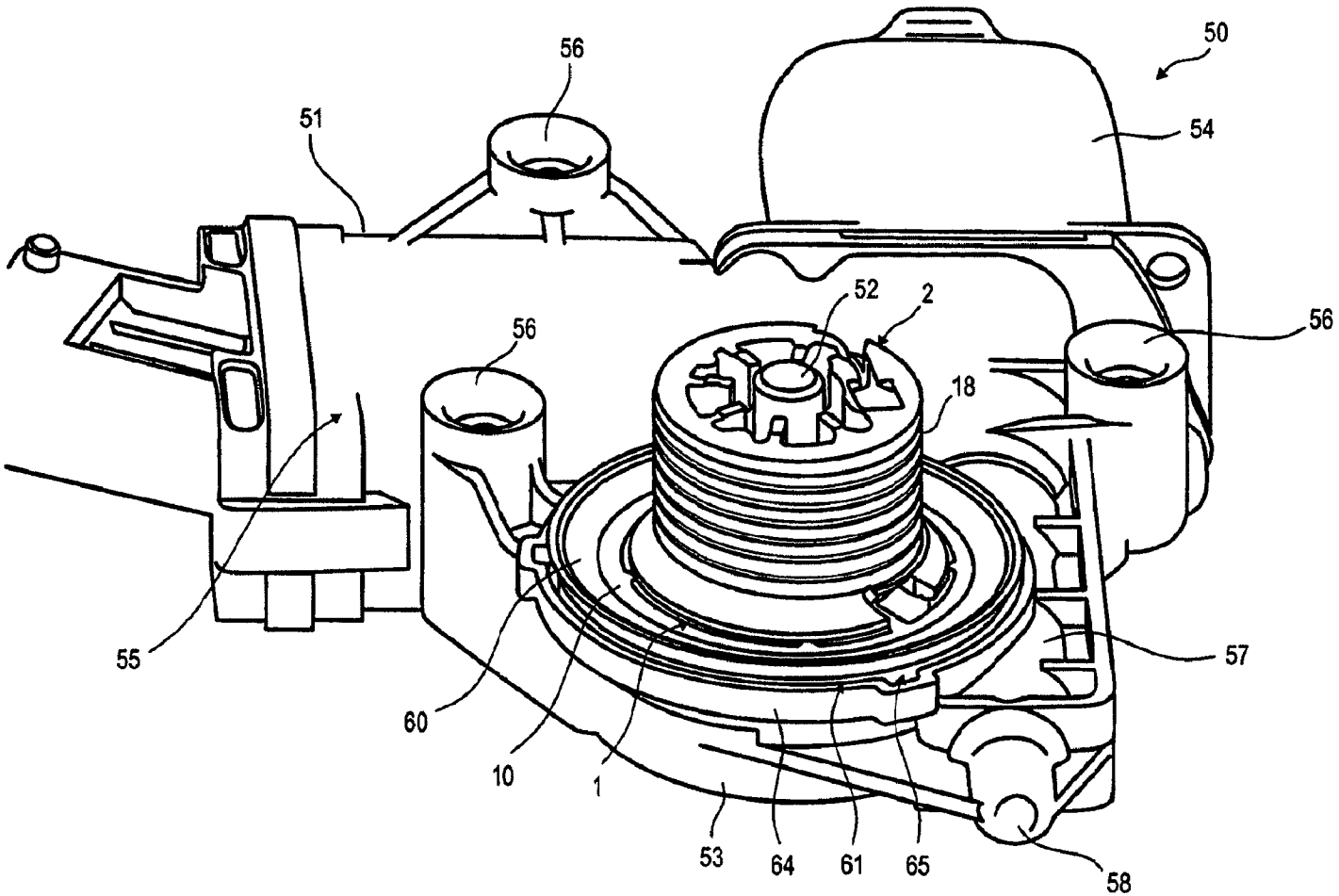
FIG. 5 shows a perspective view of a drive unit, including the installed gear mechanism unit, according to FIG. 1.
Figure 6:
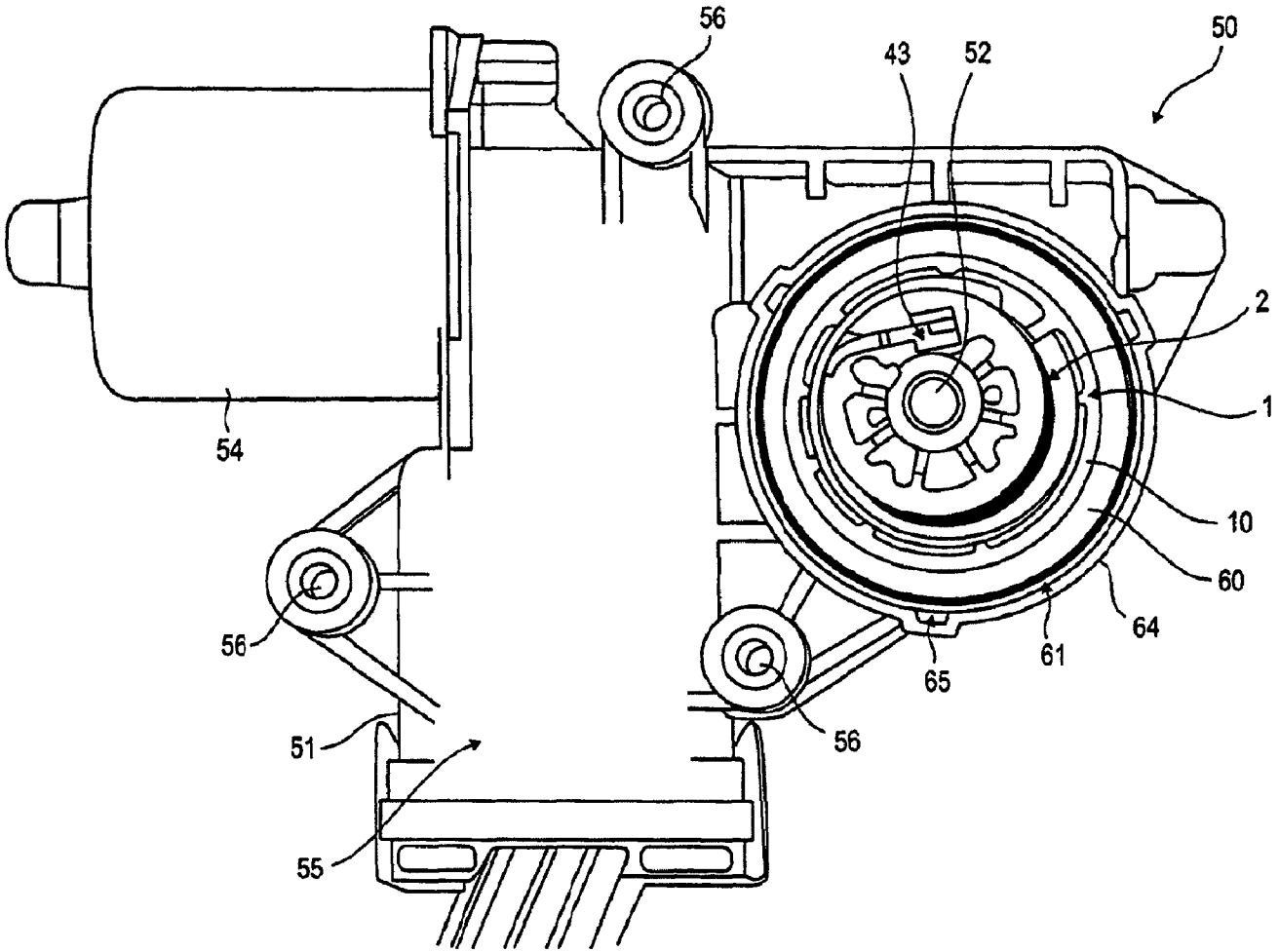
FIG. 6 shows a top view of the drive unit from FIG. 5.

FIG. 5 and FIG. 6 show a drive unit 50 for a cable-controlled window lifter comprising a housing 51 made of plastic. The gear mechanism part comprising gear wheel 1 and cable drum 2 is mounted on an axis 52 molded onto housing 51 and accommodated by a pot-shaped gear mount 53. Drum part 18 of cable drum 2 is illustrated. Gear wheel 1 is accommodated in gear mount 53. Only support surface 10 is shown. Housing 51 also accommodates a drive motor 54 for driving gear wheel 1 as well as a partially inserted control unit 55 for controlling drive motor 54. To mount the cable-controlled window lifter, the rail guide thereof is premounted on the inside of a motor vehicle door, together with the drivers and the cable. To mount the cable on the cable-controlled window lifter, the two fittings on both cable ends are subsequently inserted into fitting chambers 40, 43 and the cable ends are partially wound on cable groove 19 of the drum circumference of drum part 18 of cable drum 2. Cable drum 2 is mounted on axis 52 and connected in positive fit to gear wheel 1 via the corresponding gearing. Housing 51 of drive unit 50 may be screwed onto the inside of the motor vehicle door with the aid of three mounting bores 56.

FIG. 5 further shows that drive motor 54 is coupled to gear wheel 1 via a worm gear mechanism. Drive motor 54 is located on a plane parallel to gear wheel 1. The figure shows the orientation of drive shaft 57 of drive motor 54, which is run on a journal bearing 58 in housing 51. A worm shaft, which is not visible, is attached to drive shaft 57 and meshes with the spiral gearing of gear wheel 1.

Figure 7:
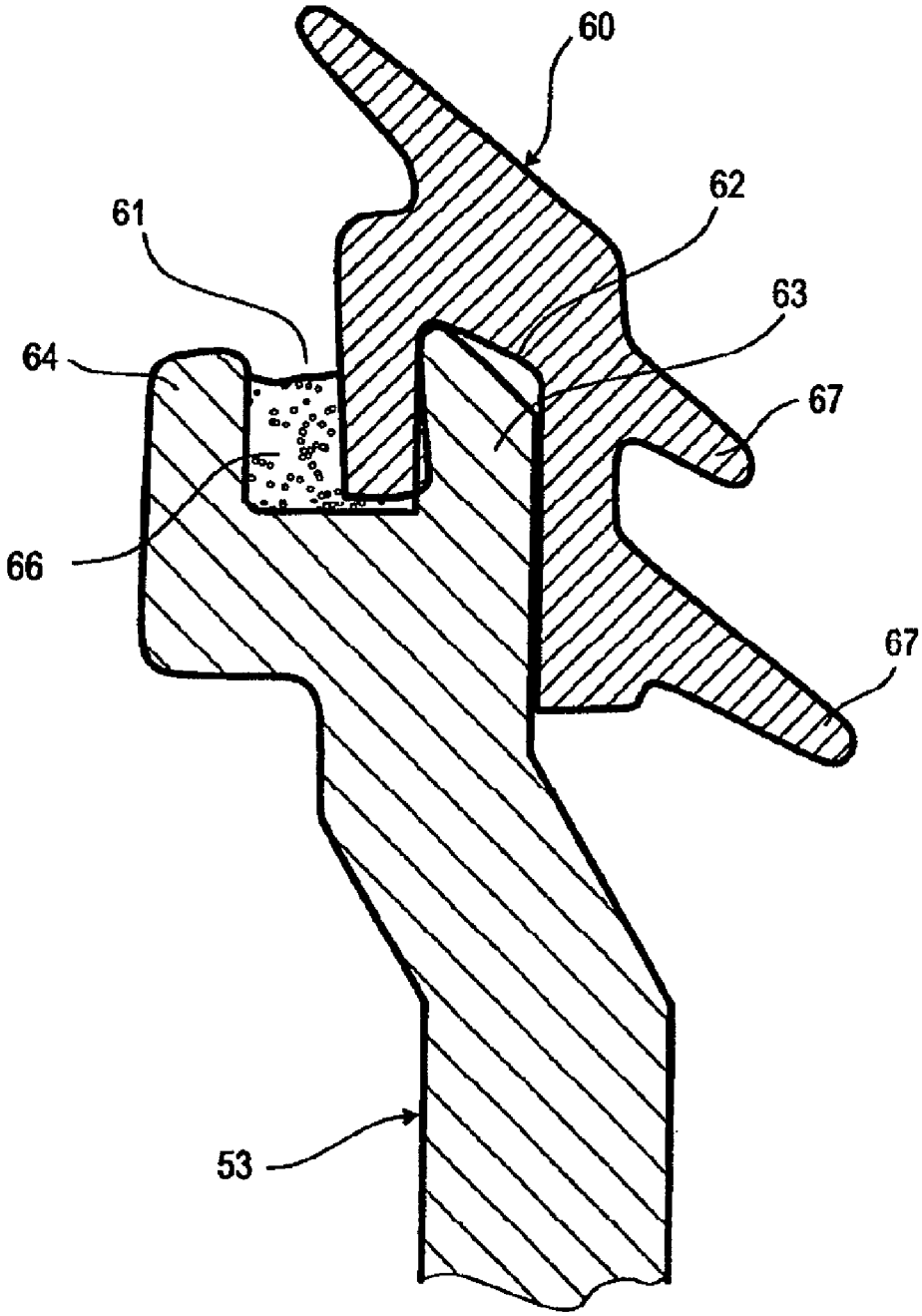
FIG. 7 shows a cross-sectional side view of the drive unit.

The gear mechanism is kept running smoothly with the aid of a lubricant and sealed to the outside by a sealing ring 60. For this purpose, sealing ring 60 is glued to the upper edge of gear mount 53. The design of sealing ring 60 is shown, in particular, in FIG. 7, which illustrates a cross-sectional view of inserted sealing ring 60 according to FIGS. 5 and 6. The upper edge of gear mount 53 includes an adhesive channel 60 having an inner wall 63 and an outer wall 64 for the purpose of gluing. Essentially conical sealing ring 60 is mounted on adhesive channel 61 in a smaller diameter. A groove running around the underside of seal 60 engages with inner wall 63 of adhesive channel 61. As illustrated in FIGS. 5 and 6, outer wall 64 of adhesive channel 61 has three pocket-like openings 65, which extend to the outside in the radial direction and which have an angular distance of approximately 120° relative to each other, starting from axis 52. These openings 65 make it possible to easily supply an adhesive 66 to adhesive channel 61. Adhesive 66 is evenly distributed from openings 65 in adhesive channel 61 and glues sealing ring 60 to adhesive channel 61. Gear wheel 1 is now sealed against support surface 10 with the aid of the two sealing lips 67. Outer wall 64 of adhesive channel 61 also secures sealing ring 60 in its position against shock or impact, which are unavoidable during mounting of drive unit 50. This reliably prevents sealing ring 60 from changing position, which could result in leakages.

In another variant, not illustrated in the figures, nubs facing to the outside in the radial direction are molded onto the outside of sealing ring 60, which engage with the openings in adhesive channel 61 and thereby secure sealing ring 60 against unwanted twisting. This is important because support surface 10 molded onto gear wheel 1, as shown in FIG. 1, rests on sealing lip 67 and rubs against sealing lip 67 of sealing ring 60 by its underside. Sealing ring 60 is therefore constantly exposed to a shearing motion during driving of gear wheel 1.

The aspects described with regard to the use of an adhesive channel 61 for gluing a sealing ring 60 is independently inventive, even if considered on its own merit and separately from the design of the gear mechanism part or the rest of the design of the drive unit.

Figure 8:
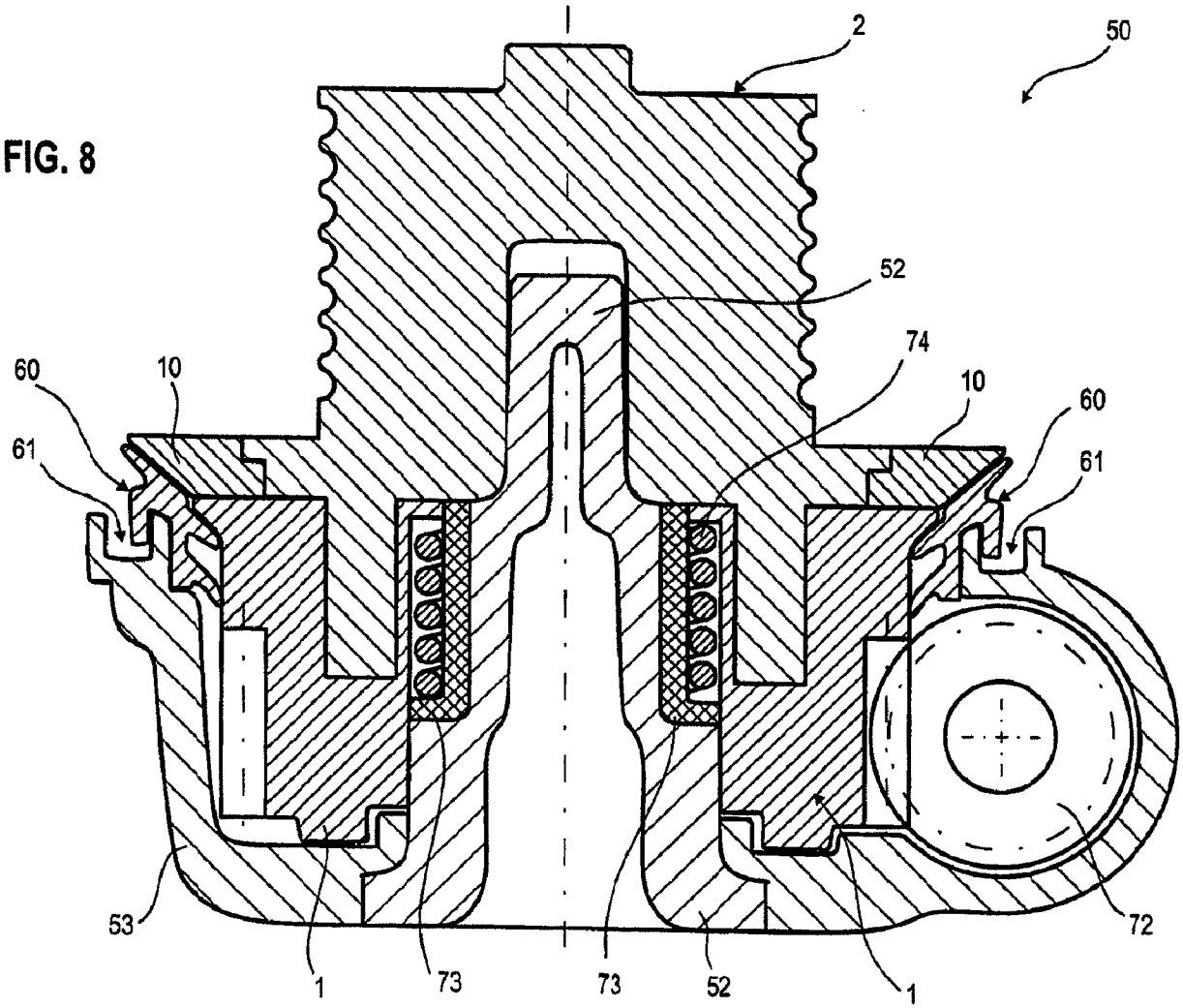
FIG. 8 shows a cross-sectional drawing of a further gear mechanism unit in a drive unit.

FIG. 8 shows a schematic illustration of a cross-sectional side view of an alternative embodiment of a drive unit 50 including a drive wheel 1. Drive wheel 1 is rotationally mounted on central axis 51 and designed as a worm wheel whose gearing meshes with a worm shaft 72 driven by drive motor 54. Axis 52 has a metallic area in the area of gear wheel 1, which is designed as a metallic sleeve 73. A wrap spring 74 having multiple windings, which is designed as a helical spring, is placed around this metallic sleeve 73, thereby establishing the function of a wrap spring brake. Both gear wheel 1 and cable drum 2 have a corresponding recess for this purpose in their interiors. Reference is hereby made to the preceding figures with regard to the further embodiments.

Figure 9:
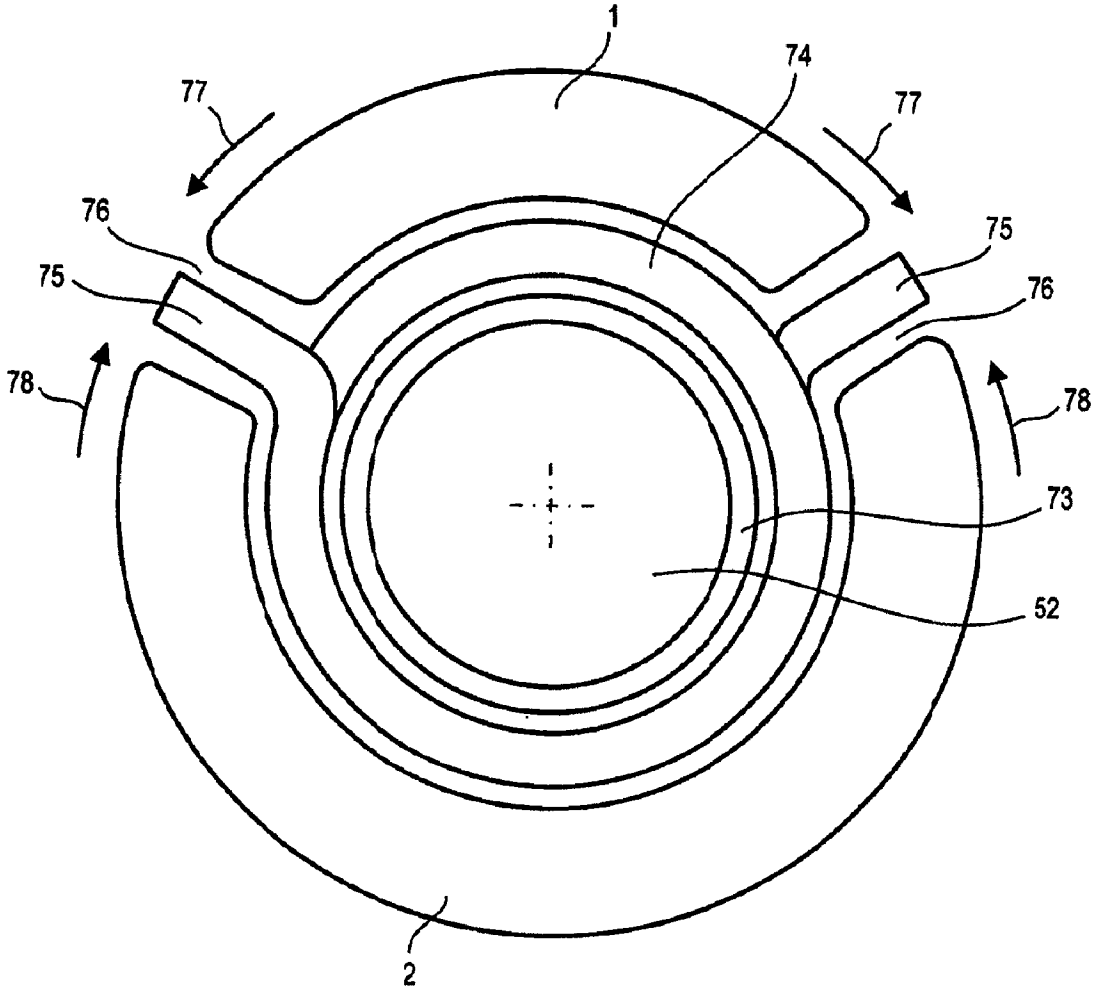
FIG. 9 shows a detail from FIG. 5.

The function of the wrap spring brake is illustrated schematically in FIG. 9. A shell is molded on gear wheel 1 and on cable drum 2 on the inside facing axis 52 for the purpose of coupling with wrap spring 74. In the interest of simplicity, these two shells are illustrated as the only elements of gear wheel 1 and cable drum 2 in the cross-sectional view at right angles to the axis longitudinal direction of axis 52. The two wrap spring ends 75 each engage with gap-shaped intermediate space 76 between the two shells. Gear wheel 1 is moved in a rotational direction 77 in the clockwise or counterclockwise direction with the aid of drive motor 54. Force is applied to the two radially bent wrap spring ends 75, and thus wrap spring 74, by the shell molded on gear wheel 1. In each case, this force is applied in opposition to the winding direction of wrap spring 74 designed as a helical spring. The winding diameter of wrap spring 74 is enlarged thereby, so that axis 52 is released. Gear wheel 1 and cable drum 2 coupled thereto in positive fit move freely on axis 52. The driving torque of drive motor 54 is transmitted to cable drum 2.

If, on the other hand, a force is applied on the driven side, in particular the weight of the window pane on cable drum 2, the shell of cable drum 2 is turned clockwise or counterclockwise in rotational direction 78 relative to the shell of gear wheel 1. Force is again applied to the two wrap spring ends 75, but in this case in the winding direction of wrap spring 72. Wrap spring 72 is tightened in the manner of a cable and wraps around metallic sleeve 73. Friction is produced between the inside of wrap spring 72 and metallic sleeve 73. In during so, metallic sleeve 73 ensures a defined friction pairing. The tightening of wrap spring 72 prevents cable drum 2 and coupled gear wheel 2 from continuing to turn. Both are supported against drive axis 52. The drive side is therefore protected against mechanical damage.

Figure 10:
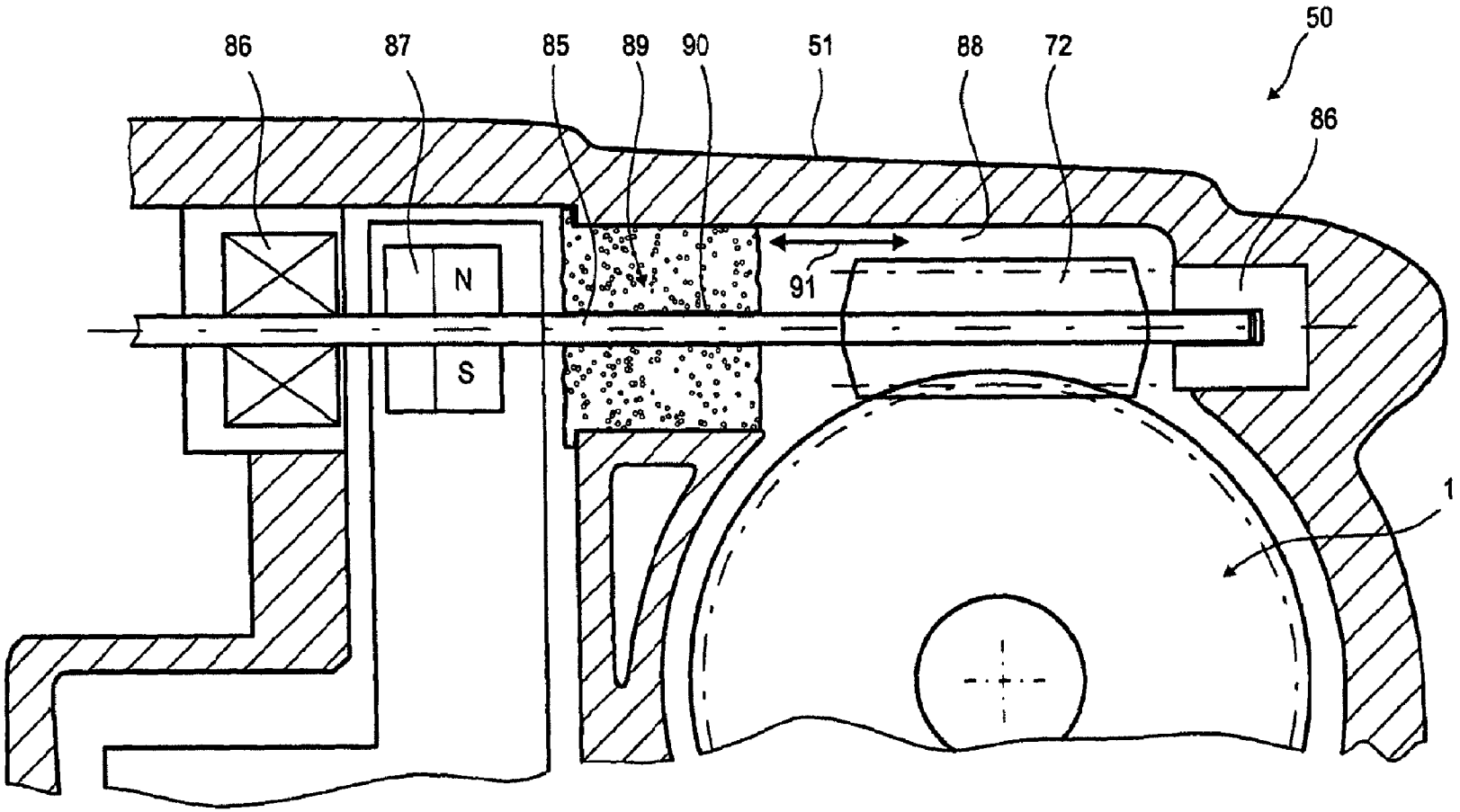
FIG. 10 shows a schematic cross-sectional drawing of a further drive unit, viewed in the transverse direction.

FIG. 10 shows a schematic cross-sectional view of drive unit 50 in the transverse direction. With the aid of a shaft 85, drive motor 54 drives worm shaft 72 mounted on said shaft 85. A spiral gearing, which is in engagement with worm shaft 72, is disposed on the outside of gear wheel 1 designed as a worm wheel. The movement of worm shaft 72 around its longitudinal axis sets gear wheel 1 in a rotational motion in the clockwise or counterclockwise direction. Via cable drum 2, which is connected in positive fit to gear wheel 1, cable drum 2 is placed in a rotational motion. One of the two cables engaging with cable drum 2 winds and the other cable unwinds. The two drivers are moved along their guides for the purpose of lifting or lowering the window pane.

Since a mechanical load is applied to shaft 85 from the driven side, shaft 85 is run on two bearings 86. A Hall sensor 87 for measuring the speed is also connected to control unit 55. The control unit of drive motor 54 uses the speed measurement either to adapt the drive power and/or for the purpose of anti-trap control. A lubricant is applied to the gear wheel and worm shaft 85 in the gear chamber for the purpose of reducing friction. The lubricant may reach built-in electrical components, such as Hall sensor 87 or control unit 55, via the shaft and produce malfunctions therein. According to the prior art, a sealing ring has been provided in shaft compartment 88 for the purpose of sealing built-in electrical components against the lubricant. However, this sealing ring, which is made, for example, of plastic, does not act as a complete seal.

According to an approach, which is inventive per se and is not dependent on the invention described herein, a flexible sealing element 89 may be provided instead of the sealing ring for sealing the built-in electrical components against the lubricant.

Sealing element 89 essentially has the cross section of shaft compartment 88. It also has a cylindrical bore 90 for accommodating shaft 85. For mounting, sealing element 89 is pushed onto the shaft, for example, prior to mounting worm shaft 72. However, it may also be provided with a slot in shaft longitudinal direction 91 for subsequent attachment to shaft 85. Flexible sealing element 89 has a slightly larger cross section than does shaft compartment 88. It is held in its position thereby. Since bore 90 is dimensioned in such a way that sealing element 89 rests on shaft 85, a complete seal is achieved. Since the inside dimension of bore 90 is only slightly smaller than the outside dimension of shaft 85, a practically unobstructed rotational motion of shaft 85 continues to be possible. The seal element is made, for example, from a rubber foam, a microcellular rubber or another elastic sealing material. In particular, a slightly porous sealing material may absorb a large amount of the sealant.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A gear mechanism part for a cable-controlled window lifter, the gear mechanism part comprising:

a gear wheel;

a cable drum drivable by the gear wheel, the gear wheel and the cable drum being disposed on a common axis, the gear wheel and the cable drum being coupled by a mating fit between an outer gearing disposed on an inner circumferential projection and an inner gearing disposed on an outer circumferential projection; and a fitting chamber for attaching cable ends said ends configured to be introduced into the cable drum, the fitting chamber being provided within the outer circumferential projection on a cross-sectional plane projected perpendicular to the axis, wherein the outer circumferential projection on the corresponding component is configured to additionally engage with an annular channel.

2. The gear mechanism part according to claim 1, wherein the outer gearing and the inner gearing include teeth and the teeth of the outer gearing or of the inner gearing each have a substantially rectangular structure.

3. The gear mechanism part according to claim 1, wherein teeth of the outer gearing or of the inner gearing are each beveled in a joining direction.

4. The gear mechanism part according to claim 1, wherein the outer circumferential projection having the inner gearing is disposed on the cable drum, and wherein the inner circumferential projection having the outer gearing is disposed on the gear wheel.

5. The gear mechanism part according to claim 4, wherein a drum circumference of the cable drum is smaller than the outer circumferential projection.

6. The gear mechanism part according to claim 1, wherein the fitting chamber is provided in the cable drum tangentially relative to the axis.

7. The gear mechanism part according to claim 1, further comprising a cable groove configured to connect the drum circumference to the fitting chamber, the cable groove being recessed into the cable drum.

8. The gear mechanism part according to claim 1, wherein two fitting chambers, which are offset against each other in an axial direction and are oriented in opposition to each other, are recessed into the cable drum, both fitting chambers being disposed within the outer circumferential projection on a cross-sectional plane projected perpendicular to the axis.

9. The gear mechanism part according to claim 8, wherein the two fitting chambers are vertically aligned in the axial direction and are formed by a continuous channel.

10. The gear mechanism part according to claim 1, wherein the gear wheel is configured as a worm wheel that meshes with a worm shaft.

11. The gear mechanism part according to claim 1, further comprising a wrap spring having ends that are in detachable engagement with the gear wheel and that are in locking engagement with the cable drum, the wrap spring being disposed on the axis.

12. The gear mechanism part according to claim 11, wherein the axis is metallized or made of metal in an area of the wrap spring.

13. A drive unit for a cable-controlled window lifter, the drive unit comprising:

a drive motor;

a control unit; and a gear mechanism part comprising:

a gear wheel;

a cable drum drivable by the gear wheel, the gear wheel and the cable drum being disposed on a common axis, the gear wheel and the cable drum being coupled by a mating fit between an outer gearing disposed on an inner circumferential projection and an inner gearing disposed on an outer circumferential projection; and a fitting chamber for attaching cable ends, said ends being configured to be introduced into the cable drum, the fitting chamber being provided within the outer circumferential projection on a cross-sectional plane projected perpendicular to the axis wherein the drive motor, the control unit and the gear mechanism part are mounted on a common housing, and wherein the outer circumferential projection on the corresponding component is configured to additionally engage with an annular channel.

14. The drive unit according to claim 13, wherein a worm shaft is provided on a shaft of the drive motor.

15. The drive unit according to claim 13, wherein an axis of the gear mechanism part is part of the common housing.

16. The drive unit according to claim 13, wherein the common housing is made of plastic.

* * * * *